US007928330B2

(12) United States Patent
Poyner et al.

(10) Patent No.: US 7,928,330 B2
(45) Date of Patent: Apr. 19, 2011

(54) SAFETY SWITCH

(75) Inventors: Julian Poyner, Stockport (GB); David T. Williams, Crickhowell (GB); Gillian P Parker, Wigan (GB); David Howard Kerr, Burscough (GB); Derek W Jones, Borgue (GB); Derek Sawyer, Granada (ES); Geoffrey Alan Talbot, Wigan (GB); William E Anderson, Cincinnati, OH (US); Michael R. Scharnick, Brookfield, WI (US); Stephen Zbytowski, Oak Creek, WI (US)

(73) Assignee: Rockwell Automation Limited, Kiln Farm, Milton Keynes (GB)

( * ) Notice: Subject to any disclaimer, the term of this patent is extended or adjusted under 35 U.S.C. 154(b) by 246 days.

(21) Appl. No.: 11/537,094

(22) Filed: Sep. 29, 2006

(65) Prior Publication Data

US 2008/0078658 A1 Apr. 3, 2008

(51) Int. Cl.
*H01H 27/00* (2006.01)

(52) U.S. Cl. ..... 200/43.07; 200/334

(58) Field of Classification Search ..... 200/17 R, 200/43.02–43.12, 61.62–61.69, 334
See application file for complete search history.

(56) References Cited

U.S. PATENT DOCUMENTS

| | | | | |
|---|---|---|---|---|
| 3,915,273 | A | 10/1975 | Loschengruber | |
| 5,464,954 | A * | 11/1995 | Kimura et al. | 200/61.62 |
| 5,587,569 | A * | 12/1996 | Mohtasham | 200/17 R |
| 5,703,339 | A | 12/1997 | Rapp et al. | |
| 5,760,353 | A | 6/1998 | Rapp | |
| 5,777,284 | A * | 7/1998 | Mohtasham | 200/43.04 |
| 5,868,243 | A * | 2/1999 | Bachle | 200/334 |
| 6,084,185 | A * | 7/2000 | Bachle | 200/43.07 |
| 7,271,355 | B2 * | 9/2007 | Yu | 200/17 R |

FOREIGN PATENT DOCUMENTS

DE 19618174 2/1997

OTHER PUBLICATIONS

European Search Report.

* cited by examiner

*Primary Examiner* — Renee Luebke
*Assistant Examiner* — Marina Fishman
(74) *Attorney, Agent, or Firm* — Boyle Fredrickson LLP; William R. Walbrun; John M. Miller

(57) ABSTRACT

There is provided a safety switch having a housing configured to receive a removable key, and a mechanism arranged to be operated when the key is moved from an engaged position to a partially disengaged position, the mechanism being arranged to cause a signal to pass to a separate apparatus, wherein the safety switch further comprises a lock which is controlled by the separate apparatus and is arranged to prevent the key from being fully disengaged from the safety switch until a signal has been received in response from the separate apparatus.

11 Claims, 4 Drawing Sheets

SAFETY SWITCH

BACKGROUND

The present invention relates to a safety switch.

In a variety of environments, including for example industrial environments, there is a need for systems that are capable of preventing access to one or more pieces of equipment or machinery whilst that equipment or machinery is operating, in a manner that is highly reliable. In some instances this may be achieved by connecting a safety switch to a control system.

Known control systems are designed to disconnect, ground and otherwise isolate controlled equipment/machinery from one or more power sources in a predictable, reliable manner, for example upon actuation of a safety switch. Such control systems reduce the chance that the controlled equipment/machinery might be unintentionally restarted at a time when it is being accessed by repair personnel or technicians for purposes or repair or modification, and thereby enhance the confidence and rapidity with which such personnel can accomplish such repairs/modifications. The power sources from which the controlled equipment/machinery are isolated by these control systems can include any of a number of power sources including, for example, electrical, pneumatic and hydraulic power sources.

Referring to FIG. 1, one prior art control system of this type is the ElectroGuard™ Bulletin 2030 Safety Isolation System available from Rockwell Automation, Inc. of Milwaukee, Wis. This control system, shown in FIG. 1 as a control system 2, includes both an electric power isolation system 4 and a pneumatic (or hydraulic) power isolation system 6, and operates as follows.

When a failure or other condition occurs at a machine 8 of an industrial system 10 (in this case, an assembly line), and an operator appropriately switches or triggers a remote lockout switch (RLS) 12 associated with that machine to an "OFF" position, the control system 2 serves to disconnect both electric power and pneumatic power lines 15 and 16, respectively, from the machine so as to as decouple the machine from both of those types of power. Additionally, the control system 2 then further serves to ground the machine 8.

Once the machine 8 has been isolated in this manner, an indication is provided to the operator (e.g. a light 18 turns on) indicating that it is appropriate for the operator to access the machine for purposes of making a repair or some other modification to the machine. Typically, the operator will then access the machine by entering into a normally-inaccessible region, e.g., by opening a gate 20 and entering into the machine as shown (alternatively, for example the operator could pass through a light curtain).

Once the operator has completed repair/modification and left the normally-inaccessible region, the operator appropriately switches or triggers the RLS 12 again, this time to an "ON" position. After this occurs, the control system 2 re-establishes the connections between the power sources and the machine 8. The control system 2 typically employs redundant circuitry such as safety relays to enhance the control system's reliability in performing its control functions in this regard.

It is an object of the present invention to provide a safety switch which may be coupled with a control system to restrict access to equipment/machinery.

SUMMARY OF THE INVENTION

According to the invention there is provided a safety switch comprising a housing configured to receive a removable key, and a mechanism arranged to be operated when the key is moved from an engaged position to a partially disengaged position, the mechanism being arranged to cause a signal to pass to a separate apparatus, wherein the safety switch further comprises a lock which is controlled by the separate apparatus and is arranged to prevent the key from being fully disengaged from the safety switch until a signal has been received in response from the separate apparatus.

The lock may comprise a solenoid operated in response to the signal received from the separate apparatus, and may comprise an arm which is receivable in an opening provided in the key.

The mechanism may comprise a cam. The mechanism may be connected to a plurality of switches which are operable by the mechanism and provide the signal which passes to the separate apparatus.

The safety switch may be provided with an indicator which is configured to be operable when the signal has been passed to the separate apparatus and before the signal has been received in response from the separate apparatus.

The safety switch may further comprise one or more additional switches which are connectable to a door or other access point of a machine, and are arranged to cause a signal to pass to the separate apparatus if the door or other access point of the machine is opened.

The safety switch may be one of a plurality of safety switches which are connected to the separate apparatus, the safety switches being arranged such that the signal received in response from the separate apparatus will not operate the lock of a given safety switch, unless the key of that safety switch has been moved from the engaged position to the partially disengaged position The separate apparatus may comprise a control system which controls the supply of power to a machine, the control system being arranged to interrupt the supply of power to the machine upon receiving the signal from the safety switch, and then output the response signal to the safety switch.

According to a second aspect of the invention there is provided a safety switch and control system, the safety switch comprising a housing configured to receive a removable key, and a mechanism arranged to be operated when the key is moved from an engaged position to a partially disengaged position, the mechanism being arranged to cause a signal to pass to the control system which controls the supply of power to a machine, the control system being arranged to interrupt the supply of power to the machine upon receiving the signal from the safety switch, and then output the response signal to the safety switch, the safety switch further comprising a lock which is arranged to prevent the key from being fully disengaged from the safety switch until the response signal has been received from the control system.

The control system may be arranged to delay sending the response signal until a predetermined period has elapsed after the supply of power to the machine has been interrupted.

BRIEF DESCRIPTION OF THE DRAWINGS

A specific embodiment of the invention will now be described by way of example only, with reference to the accompanying drawings in which.

DETAILED DESCRIPTION

Figures 2A, 2B, 2C:
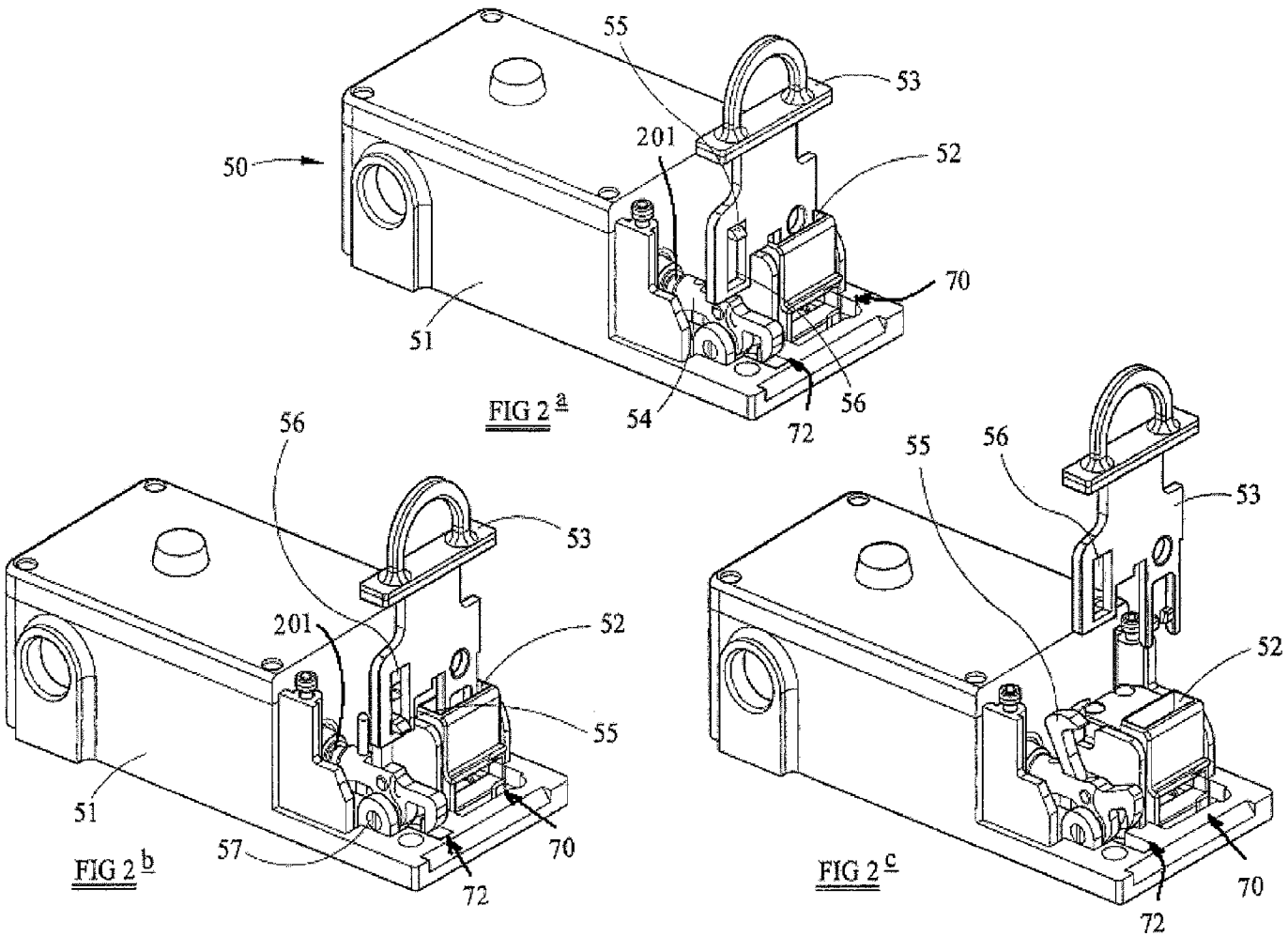
FIGS. 2*a* through 2*c* are perspective views of a safety switch which embodies the invention.

A safety switch according to the present invention is shown in FIGS. 2*a* through 2*c*. The safety switch 50 comprises a housing 51 which contains a set of switches and a solenoid (not visible). An opening 52 at one end of the housing is arranged to receive a key 53. A locking claw 54 extends from the housing and includes an arm 55 which is received in a slot 56 provided in the key 53. The locking claw 54 and arm 55 act as a lock 72.

The safety switch 50 may be provided at a door of equipment/machinery, and arranged such that the door may be opened only when the safety switch has been actuated. For example, the key 53 may be mounted on the door, with the housing 51 being mounted on a door post, such that the door cannot be opened without first removing the key from the housing. The safety switch 50 is arranged to interact with a control system to control the supply of power to the machine, such that power cannot be supplied to the machine once the safety switch has been actuated.

Referring to FIG. 2*b*, if a user wishes to open the door of the machine then he/she must remove the key 53 from the housing 51. The user pulls the key 53 outwards from the housing (this is upwards in FIG. 2*b*), the key 53 moves through a limited distance, but is prevented from moving further when the arm 55 engages with a lower end of the slot 56. This movement of the key 53 causes a cam mechanism (not visible) located beneath the opening 52 of mechanism 70 to be rotated. The cam of mechanism 70 in turn operates the switches within the housing 51 (this may for example be done via an actuator arm). This causes an electrical signal to be sent to a control system (not illustrated) requesting that the supply of power to the machine be interrupted. The manner in which the signal is sent is described further below. The control system interrupts the supply of power to the machine, then sends a verification signal to the safety switch indicating that the power supply has been interrupted. Upon receipt of the verification signal, the solenoid located within the housing 51 is actuated. The solenoid 201 is connected to the locking claw 54, and actuation of the solenoid 201 causes the locking claw to be retracted. The locking claw includes a pivot 57, which causes the arm 55 to be rotated out from the slot 56 when the solenoid 201 is actuated.

Referring to FIG. 2*c*, once the arm 55 has been rotated out of the slot 56 of the key 53, the key may be removed from the housing 51. This allows the door of the equipment/machinery to be opened, which in turn allows the user to access the equipment/machinery.

Although the switches have been described as being operated by a cam, it will be appreciated that any other suitable mechanism 70 may be used. Similarly, the locking claw 54 and arm 55 may be replaced by any other suitable mechanism arranged to prevent the key 53 from being removed from the housing until a verification signal is received.

Figure 3:
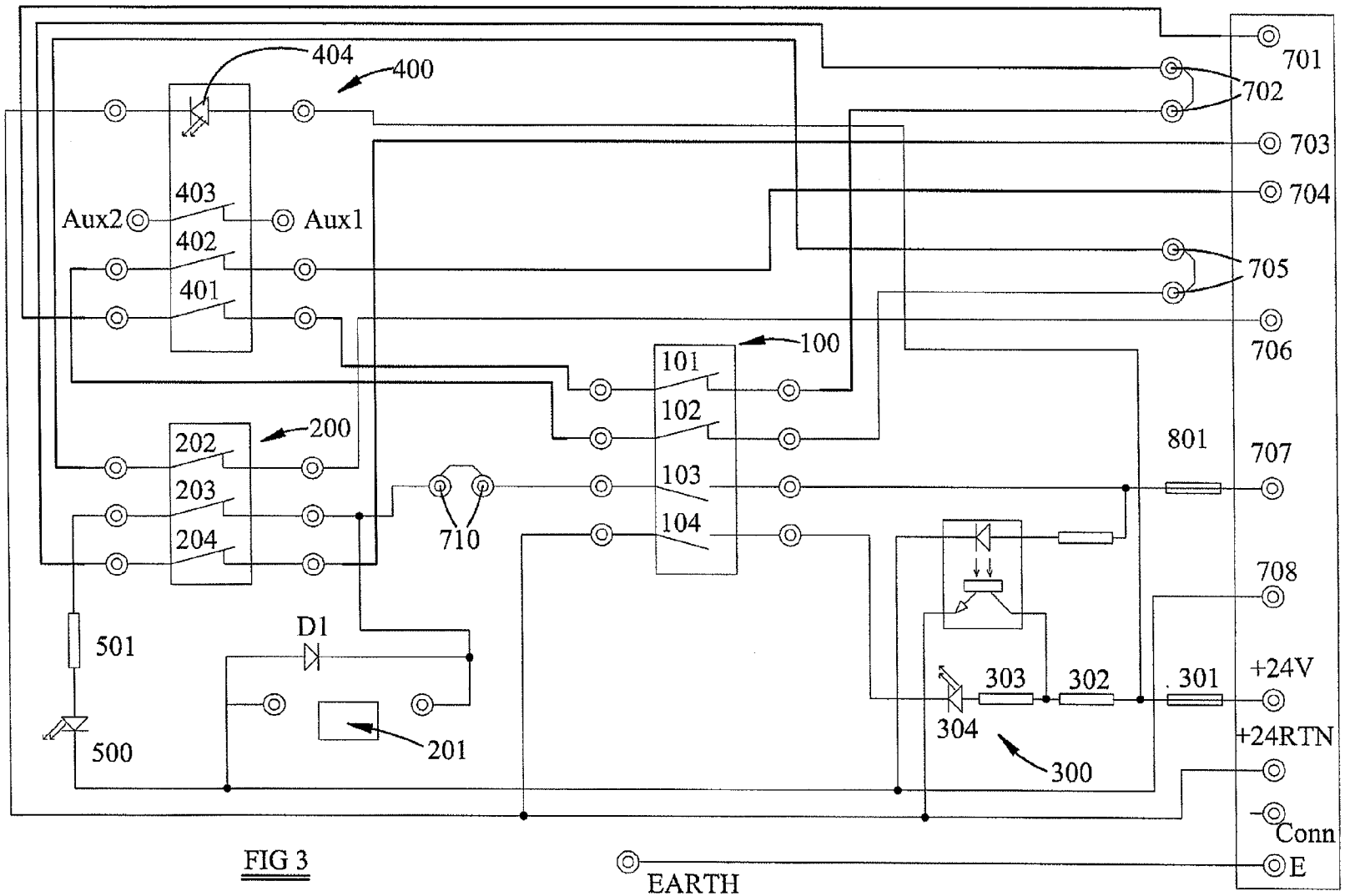
FIG. 3 is a diagram of circuit which forms part of the safety switch.

FIG. 3 shows a circuit which, at least in part, is located within the safety switch housing 51 and forms part of the safety switch. In general terms, the circuit comprises a set of switches 100 (referred to above), a set of monitoring contacts 200 actuated by a solenoid (referred to above), a status LED and associated control circuit 300, a set of door actuated contacts 400, and a second status LED 500.

The set of switches 100 comprises four switches 101-104. First and second switches 101, 102 are normally closed, whereas third and fourth switches 103, 104 are normally open. The set of switches is of the break before make type, such that the first and second switches 101, 102 will open before the third and fourth switches are allowed to close.

When the first and second switches 101, 102 are closed, the circuit generates an output which causes the control system to allow power to be supplied to the machine. When the first and second switches 101, 102 are opened the circuit provides an output which causes the control system to interrupt the supply of power to the machine.

When the first switch 101 is closed it provides a closed circuit between a first terminal 701 of the circuit, via a first door actuated contact 401 and a pair of linked terminals 702, to a second terminal 703 of the circuit. Similarly, when the second switch 102 is closed it provides a closed circuit between a third terminal 704 of the circuit, via a second door actuated contact 402 and a second pair of linked terminals 705, to a fourth terminal 706 of the circuit. The closed circuits are monitored by the control system, which has inputs connected to the first, second., third and fourth terminals 701, 703, 704, 706. The control system may be located adjacent to the power supply for the machine. This may be some distance away from the machine itself.

Figure 4:
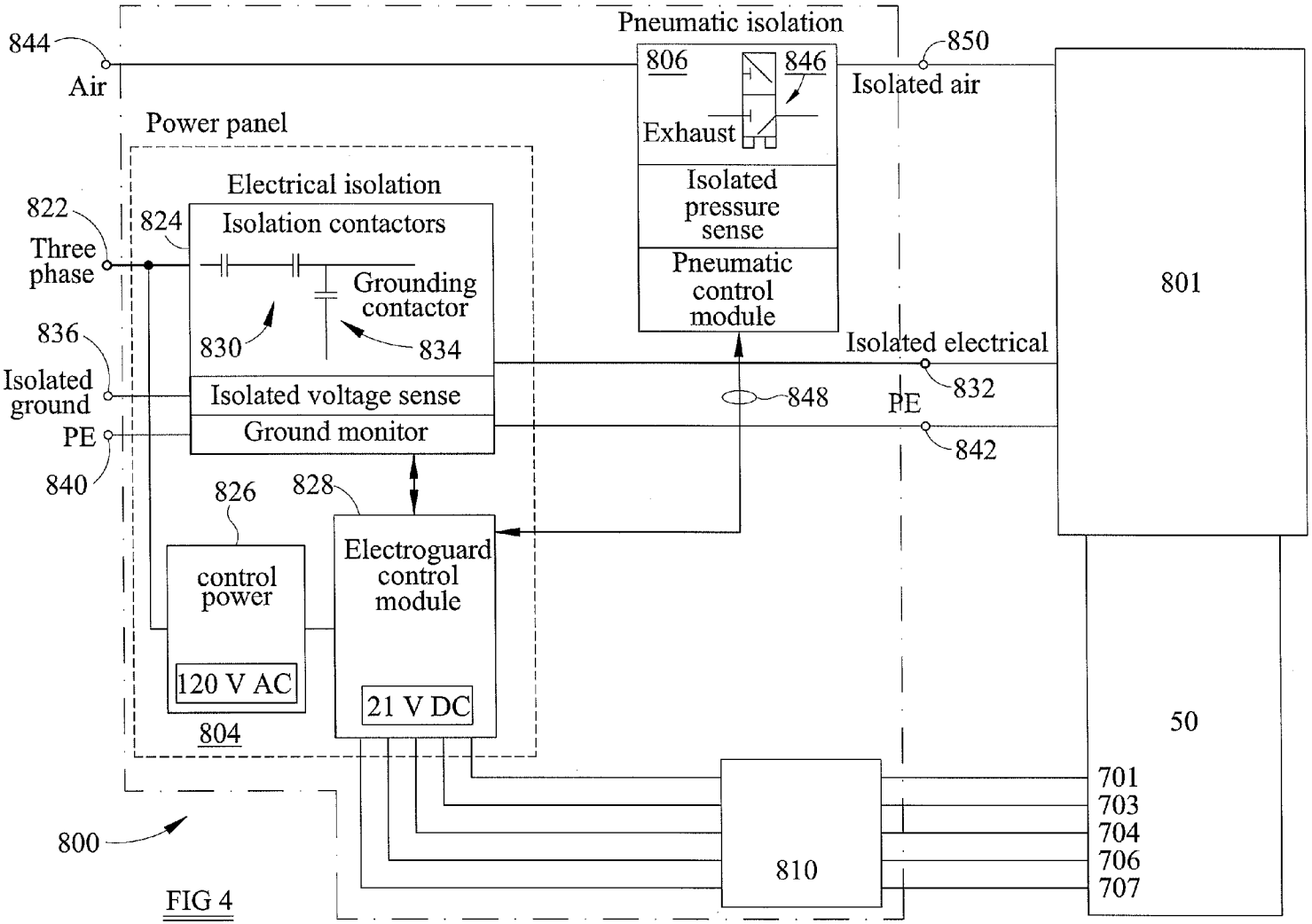
FIG. 4 is a schematic diagram of a control system connected to the safety switch.

The control system is shown schematically in FIG. 4. The control system 800 is connected to terminals 701, 703, 704. 706 of the safety switch 50, and is connected to a machine 801. The machine 801 may be part of an assembly line or other industrial system. However, the machine 801 is also generally intended to be representative or one or more machines or other piece of equipment of a variety of types for implementation in a variety of industrial or other circumstances, for example, in other large facilities that implement various processes such as hospitals, airports (e.g., a baggage handling system), etc.

The control system 800 includes an electric power isolation system 804 and a pneumatic (or, alternatively, hydraulic) power isolation system 806. The electric power isolation system 804 receives three-phase power from a three-phase power source (not shown) by way of an electrical input port 822. The three-phase power received at the electrical input port 822 is provided both to an electrical isolation module 824 and a control power module 826. The control power module 826 converts the three-phase power into 120 Volt AC power, which it then provides to an internal control module 828.

The internal control module 828 governs the operation of the electrical isolation module 824 based upon signals that it receives from the safety switch 51. When an open circuit occurs across the first and second terminals 701. 703 and/or the third and fourth terminals 704, 706, the internal control module 828 causes isolation contactors 830 within the electrical isolation module 824 to open so as to disconnect the three-phase power received at the electrical input port 822 from an electrical output port 832.

Subsequently, grounding contactors 834 within the electrical isolation module 824 are further actuated by the internal control module 828 so as to couple the electrical output port 832 to ground. More particularly, in the preferred embodiment, the electrical output port 832 is coupled to an isolated ground port 836 of the electrical power isolation system 804. Also as shown, the electric power isolation system 804 includes a protective earth (PE) input terminal 840, and a PE output terminal 842. The PE input terminal 840 is coupled to a standard earth ground, and the PE output terminal 842 is coupled both to the PE input terminal 840 and in turn to the machine 801 such that the machine has access to the standard earth ground. Thus, by virtue of the operation of the isolation contactors 830 and the grounding contactors 834, the machine 801 is entirely isolated from the three-phase power source and grounded.

Further as shown in FIG. 4, the pneumatic power isolation system 806 is capable of receiving pressurized air at an air input port 844. One or more valves 846 within the pneumatic power isolation system 806 are controlled by way of signals provided from the internal control module 828, to which the pneumatic power isolation system 806 is coupled by way of one or more communication links 848. Similar to the operation of the electric power isolation system 804, when an open circuit occurs across the first and second terminals 701, 703 and/or the third and fourth terminals 704, 706, the air output port 850 is decoupled and isolated from the air input port 844.

Thus, when an open circuit is detected across the terminals 701, 703, 704, 706, the machine 808, which is coupled to each of the output ports 832 and 850, ceases to receive any electrical or pneumatic power and is isolated from the power sources coupled to the input ports 822 and 844. However, when a closed circuit is established across the terminals 701, 703, 704, 706, the internal control module 828 causes the electrical power isolation system 804 and the pneumatic isolation system 806 to maintain the connections between those power sources and the machine 808.

The control system 800 further comprises a verification module 810, which is arranged to monitor the terminals 701, 703, 704, 706 and to monitor signals output from the internal control module 828.

When the key 53 of the safety switch 50 is moved to the first position (see FIG. 2*b*), it causes the first and second switches 101, 102 to open. The switches 101, 102 open simultaneously., thereby causing open circuits to occur simultaneously across the first and second terminals 701, 703 and the third and fourth terminals 704, 706. This causes the internal control module 828 to operate the electrical isolation contactors 130 and pneumatic valves 146, and to ground the machine 801. The verification module 810 monitors whether or not the open circuits occurred simultaneously. If the open circuits do not occur simultaneously, then an error signal is generated by the verification module 810. An engineer is then required to check the safety switch circuit and, upon satisfaction that the safety switch is operating correctly, reset the verification module and thereby allow power to be supplied to the machine 801. If the verification module 810 determines that the open circuits occurred simultaneously, then no error signal is generated.

The switches 101-104 are linked such that they operate together, with the qualification that those switches which are closed will move to open configurations before those switches which are open are allowed to move to closed configuration. Thus, once the first and second switches 101, 102 have opened, the third and fourth switches 103, 104 are closed. The third switch 103 does not have any effect at this stage, since no power is supplied to a fifth terminal (terminal 707) to which it is connected.

Closing the fourth switch 104 allows a 24 Volt power supply (not illustrated) to supply power through a sixth terminal (terminal 708), via a fuse 301 and a pair of resistors 302.303, to a yellow LED 304. The yellow LED 304, which may be located adjacent to the switch, is thereby illuminated, indicating that a request to turn off the power supply has been sent from the safety switch circuit to the control system 800.

Once the control system 800 has isolated the machine from the power supply (the manner in which this is done is described above), this is communicated from the control module 828 to the verification module 81 0. The verification module 810 then sends a verification signal to the fifth terminal 707 (i.e. it applies a voltage to the fifth terminal). This will only occur if the verification module 810 has not detected an error. There may be a time delay between the verification module 810 receiving the signal from the control module and sending the verification signal to the fifth terminal 707.

The verification signal passes via a fuse 801, the closed third switch 103, and a pair of linked terminals 710 to a solenoid 201. The solenoid 201 is energised, and on being energised actuates the solenoid actuated monitoring contacts 200. First and third monitoring contacts 202, 204 move from closed configurations to open configurations. The second monitoring contact 203 moves from an open configuration to a closed configuration.

The effect of closing the second monitoring contact 203 is to allow the verification signal to pass to the second status LED 500 via a resistor 501. The second status LED 500, which is preferably green and is located adjacent to the safety switch, is illuminated. This indicates that the machine has been isolated from the power supply.

Figure 1:
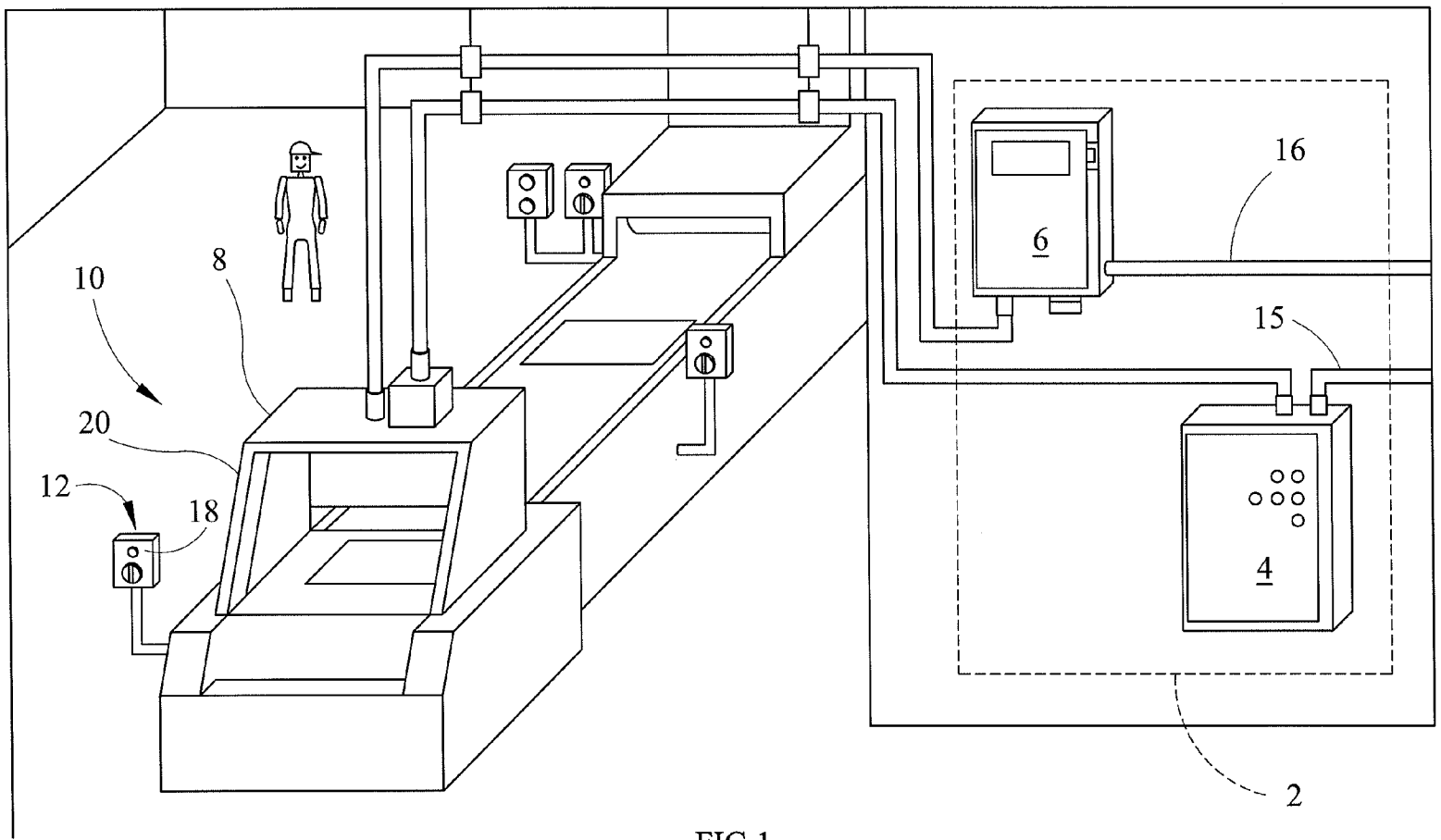
FIG 1 ( PRIOR ART )
FIG. 1 is a schematic illustration of a prior art control system.

The claw 54, described above in relation to FIG. 1, mounted on the solenoid 201 is actuated and pulls the arm 55 out from the slot 56 in the key 53. This allows the key 53 to be removed from the housing 51, which in turn allows a door to be opened so that the machine can be accessed.

In some instances the machine may be sufficiently large that for practical purposes more than one door is required. Where a plurality of doors is provided, each is provided with its own safety switch 50 and safety switch circuit. When the key associated with a given safety switch is moved to the first position., as shown FIG. 2*b*, the safety switch circuit sends a request to the control system 800 that the power supply be turned off. The verification signal output by the control system 800 upon turning off the power supply is received at each safety switch. The verification signal causes only the solenoid 201 of the actuated safety switch to be activated, thereby allowing access to the machinery at that location. The verification signal does not reach corresponding solenoids of other safety switches. This is because the keys of those switches have not been moved to the first position, so that the verification signal is isolated by the third switch 103 of each safety switch.

Access to the machine is possible at other locations by moving the key of the safety switch at that location to the first position. This causes the third switch 103 to close, thereby causing the solenoid 201 to be actuated, and allowing the key to be fully removed from the safety switch by a user. The user may then access the machine via the door controlled by that safety switch. An advantage of this arrangement is that the verification signal from the control panel does not cause all of the safety switches connected to the control panel to unlock. Instead, the only switches that are unlocked are those at which an access request has been made (i.e. by moving the key to the first position).

In some instances the verification module may be configured to incur a delay between receiving an output from the control module 828 indicating that power to the machine 801 has been interrupted, and the verification signal being sent to the fifth terminal 707. This may be necessary if for example it takes a few seconds for the machine 801 to come to a complete stop after it has been isolated from the power supply. The user will know that a request to isolate the machine from the power supply has been sent, since this is indicated by the yellow LED. It should be understood that it is not possible to remove the key 53 from the safety switch housing 50 until the green LED is illuminated. The user will also be informed that upon a request for entry there must be a sequence of yellow LED illuminated then green LED illuminated. The user will further understand to enter only when the correct sequence has occurred.

In some instances damage might allow the door of the machine to be opened without the safety switch 50 being operated. For example, in one arrangement the key 53 may be provided on a chain which is secured to a door of the machine 801. This means that the door can only be opened when the key 53 has been removed from the safety switch housing 51 thereby actuating the switches 101-104 as described above. However, the chain which connects the key 53 to the door ma) be broken, thereby allowing the door to be opened without removing the key 53 from the housing 51. The set of door actuated contacts 400 is included in the safety circuit to ensure that access to machine 801 cannot occur whilst the machine is in operation.

The set of door actuated contacts 400 are reed switches which are actuated by a door of the machine 801. When the door is closed, the first and second door actuated contacts 401, 402 remain closed. If the door is opened without first operating the safety switch, then the door actuated contacts 401, 402 move to open configurations, thereby causing open circuits across the terminals 701, 703 and 704, 706. The control system thus isolates the machine from the power supply 122. An auxiliary contact 403, which may also be a reed switch, is also actuated by the door and causes power to be supplied to an LED 404 via a relay (not illustrated). The illuminated LED shows that the door is open. The LED may be for example replaced by an illuminated sign which indicates that the door is open.

It will be appreciated that the set of door actuated contacts 400 are actuated even if the switch has been correctly operated. This will have no effect at the terminals 701. 703 and 704,706, since an open circuit already exists across them. It will however cause the LED to be illuminated to show that the door is open. In addition, the set of door actuated contacts ensures that power cannot be returned to the machine 801 until the door is closed.

The first and third monitoring contacts 202, 204 are provided to ensure that if the claw of the switch becomes stuck in the retracted position, it is not possible to accidentally open the door by removing the key from the switch, without first causing the power supply to be switched off. In effect, the first and third monitoring contacts 202, 204 monitor the position of the solenoid 400.

The verification signal provided from the verification module 810 to the fifth terminal 707 is electrically isolated from other parts of the safety circuit, and is connected to a different ground. This is to ensure that if a spurious cross fault occurs between for example the fourth terminal 706 and the fifth terminal 707, this will not cause the safety circuit to malfunction.

Although the connections from the switch to the supply panel have been described as being from specific terminals it will be appreciated that, depending upon the control system that is used, connections may be made to different terminals. This is the reason for the pairs of linked terminals 702, 702, 710.

Although the set of door actuated contacts 400 have been described as being reed switches, it will be appreciated that any other suitable switches may be used.

What we claim is:

1. A safety switch assembly comprising:

a housing;

an opening formed in the housing;

a key having a first portion and a second portion that is offset from the first portion, the first portion of the key cooperating with the opening formed in the housing altering an operating condition of a control system of a machine;

a lock constructed to directly engage the second portion of the key, the key cooperating with the opening to be movable between a fully engaged position wherein the control system allows operation of the machine and the lock is directly engaged with the key, a partially engaged position wherein the control system suspends operation of the machine and the lock remains directly engaged with the key thereby preventing disengagement of the key from the opening and the control system generates a verification signal indicating suspension of operation of the machine, and a disengaged position wherein the key is removed from the opening and the lock is disengaged from the second portion of the key so that the key can be removed from the safety switch assembly only upon receipt of a verification signal from the control system indicating suspension of operation of the machine.

2. The safety switch according to claim 1 wherein the lock comprises a solenoid operated in response to the verification signal.

3. The safety switch according to claim 1 wherein the lock comprises an arm which engages a slot formed in the in the key and does not interfere with movement of the key between the fully engaged and partially engaged positions.

4. The safety switch according to claim l further comprising an indicator which is configured to be operable when the key is moved from the fully engaged position to the partially engaged position and before receipt of the verification signal.

5. The safety switch according to claim 1 further comprising one or more safety switches, each safety switch connectable to one of a door or access point of the machine and arranged to cause a signal to pass to the control system if the door or access point of the machine is opened.

6. The safety switch according to claim 1 wherein the safety switch is one of a plurality of safety switches which are connected to the control system and each of the safety switches is arranged to disengage a respective lock from a respective key only if the respective key has been moved to a partially disengaged position.

7. An electrical switch system comprising:

a safety switch having a housing configured to receive a first portion of a removable key and operable to alter operation of a machine when the key is moved from an engaged position to a partially disengaged position while the key is received by the housing;

a control system constructed to receive a signal from the safety switch to control the supply of power to the machine and arranged to interrupt the supply of power to the machine upon receiving a signal from the safety switch and then output a verification signal to the safety switch; and a lock that directly engages a second portion of the key that is offset from the first portion of the key and allows the key to move relative to the safety switch between a fully engaged position and a partially engaged position to alter operation of the machine when the lock is engaged with second portion of the key, the lock preventing the key from being fully disengaged from the safety switch until the verification signal has been received from the control system.

8. The electrical switch system of claim 7 wherein the control system is arranged to delay sending the verification signal until a predetermined period has elapsed after the supply of power to the machine has been interrupted.

9. A safety switch mechanism comprising:

a housing that encloses a plurality of conductors;

a key constructed to engage the housing and open and close an electrical circuit associated with plurality of conductors; and a control system connected to a machine arranged to be operated by the key, the key being movable between an engaged position and a partially disengaged position wherein the key remains engaged with the housing, the control system being arranged to cause a signal to pass to a verification module; and a lock that directly engages the key and is controlled by the verification module to prevent the key from being fully disengaged from the safety switch until a signal has been received from the verification module indicative of a condition of the machine, the lock including a solenoid connected to a claw that extends beyond a perimeter of the housing of the safety switch and an end of the claw engages the key.

10. The safety switch mechanism of claim 9 wherein the key can only be fully removed from the housing when the condition of the machine is at least one of a no-power indication or a no movement indication.

11. The safety switch mechanism of claim 9 wherein the housing is attached to one of a door and the machine and the key is attached to the other of the door and the machine.

* * * * *